United States Patent [19]

Cook

[11] 4,279,137

[45] Jul. 21, 1981

[54] SECURITY DEVICE

[76] Inventor: Roy O. Cook, 2016 Main St., Houston, Tex. 77056

[21] Appl. No.: 73,144

[22] Filed: Sep. 6, 1979

[51] Int. Cl.[3] ..... E05B 63/00

[52] U.S. Cl. ..... 70/416

[58] Field of Search ..... 70/416, 419, 429, 430, 70/431, 447

[56] References Cited

U.S. PATENT DOCUMENTS

| | | | |
|---|---|---|---|
| 2,463,195 | 3/1949 | Morgan | 70/416 |
| 3,585,827 | 6/1971 | Dominguez | 70/416 |
| 3,862,556 | 1/1975 | Moses | 70/416 |
| 3,933,014 | 1/1976 | Moses | 70/416 |

*Primary Examiner*—Robert L. Wolfe

*Attorney, Agent, or Firm*—Robert W. B. Dickerson

[57] ABSTRACT

A device for preventing a dead bolt handle from being turned, comprising a knob encompassing portion depending from a handle accommodating housing. Said encompassing portion and housing so coact that the tendency of said device to rotate on said handle being turned is barred by said knob encompassing portion abutting a door knob.

1 Claim, 2 Drawing Figures

SECURITY DEVICE

BACKGROUND OF THE INVENTION

Devices and techniques have been developed by the unscrupulous to open locked doors from the outside, thereby permitting illegal entry into homes, apartments, hotel rooms and the like. It, therefore, has long been desirable for occupants to assure that dead bolts may not be so opened. Various improvements have been so developed with a goal of preventing locks, particularly dead bolts, from being turned or operated from without. This invention not only bars such turning, but also may be quickly removed from the inside in the event the occupant need exit hastily, such as in the event of fire.

SUMMARY OF THE INVENTION

A unitary member includes a pair of legs adapted to be positioned on opposite sides of a door knob. Above such legs, a housing is provided to receive the handle or knob portion of a dead bolt, such handle acting as a pivot when the bolt handle is caused to turn. The presence of the knob encompassing legs prevents the device from turning, thereby preventing the bolt handle from turning. The member includes, on its opposite faces, means for accommodating differently sized bolt handles.

DESCRIPTION OF A PREFERRED EMBODIMENT

Figure 1:
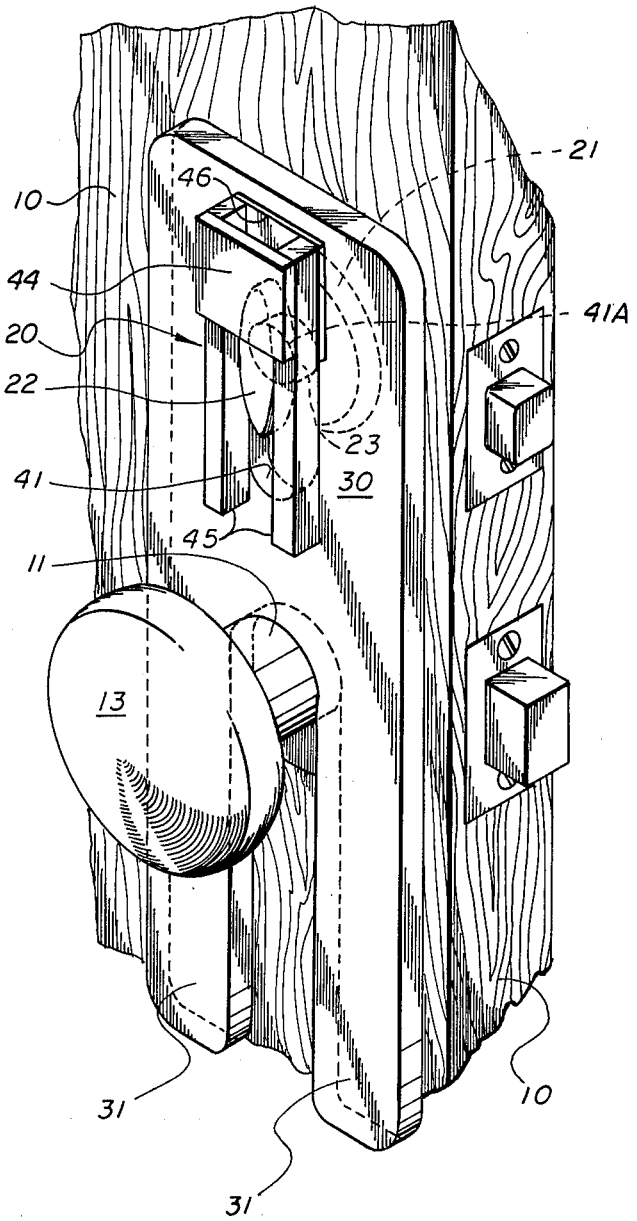
FIG. 1 is a perspective of the device as affixed to a door having a knob and dead bolt, said door only being partially shown.

A door 10 includes a standard knob 13 having a shaft 11, and a dead bolt assembly 20. The dead bolt includes facing 21, a shaft 23 and an operating handle 22.

This inventive device, preferably made of a clear strong plastic material includes a body portion 30, with spaced apart legs 31 depending therefrom, said legs encompassing the door knob shaft 11. Above said legs, body 30 includes vertically elongated aperture 41. Adjacent said aperture, on one side of body 30, a housing is provided for removably receiving dead bolt handle 22. Said housing includes a pair of vertical struts 45 along side aperture 41, and plate 44 connecting the upper portion of said struts. A further plate 46 is fixed to the opposite face of body 30.

Figure 2:
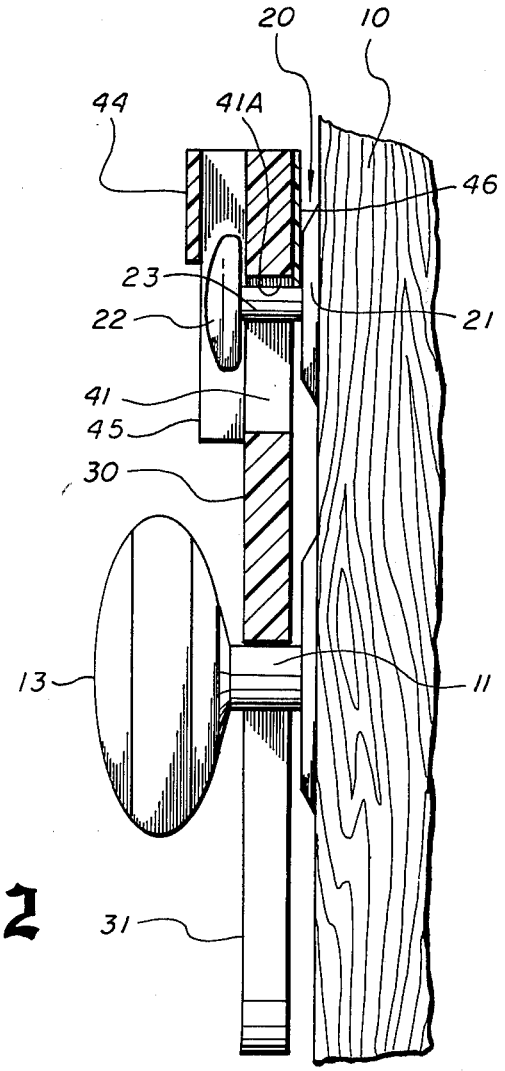
FIG. 2 is a vertical section through the assembly.

Normally, the device is put in place by having legs 31 straddle knob shaft 11, and dead bolt handle 22 inserted under plate 46, through aperture 41, to enter the space intermediate body 30 above aperture 41, to the right of plate 44 in FIG. 2. In this position, the upper reaches of aperture 41, as at 41*a*, would rest astride and tend to pivot about the shaft 23 of the dead bolt handle. Should a potential intruder attempt to cause the dead bolt handle to turn from the outside of an occupant's room, such action would tend to rotate the device about the dead bolt shaft, whereon one of legs 31 sould encounter the door knob shaft 11, blocking further movement. Although such device is inherently simple, it not only offers protection against intruders, but also is easily removed by the occupant in case of emergency, ie., by simply slightly lifting the device so that the dead bolt handle may exit aperture and removing it. In the event of a larger dead bolt handle, body 30 would be reversed, with the dead bolt handle entering under plate 44 and such plate pivoting about shaft 23.

Further expediencies would be possible, such as by attaching a room key to body 30, and/or by chaining housing 30 to the door. In any case, while numerous modifications would be possible by one skilled in the art without departing from the spirit of the invention, the scope should be limited only by the following claims.

I claim:

1. A security device for use in conjunction with a door having a knob and a dead bolt, said device comprising:

a rigid, planar body portion including a pair of spaced apart legs forming the lower part thereof so spaced so as to straddle the shaft of said knob;

a vertically elongated aperture through said body of such size as to permit the handle of said dead bolt to pass therethrough and so arranged as to permit the body above the aperture to pivot about the handle shaft; and means to prevent said handle from rotating sufficiently to open said dead bolt, said preventing means including said legs, a pair of struts affixed to said body portion on opposite sides of said elongated aperture and separated by a distance less than the length of the handle of said dead bolt, and a plate member connecting said struts adjacent the upper reaches of said elongated aperture, said plate, struts and body portion forming a cavity for receiving one end of said dead bolt handle yet blocking rotation of said handle.

* * * * *